US008791885B2

(12) United States Patent
Mori et al.

(10) Patent No.: US 8,791,885 B2
(45) Date of Patent: Jul. 29, 2014

(54) SELF-LIGHT-EMITTING DISPLAY DEVICE, POWER CONSUMPTION REDUCTION METHOD, AND PROGRAM

(75) Inventors: Hideto Mori, Tokyo (JP); Hiroshi Imamura, Kanagawa (JP); Yasufumi Ogawa, Tokyo (JP)

(73) Assignee: Sony Corporation, Tokyo (JP)

( * ) Notice: Subject to any disclaimer, the term of this patent is extended or adjusted under 35 U.S.C. 154(b) by 880 days.

(21) Appl. No.: 12/783,942

(22) Filed: May 20, 2010

(65) Prior Publication Data

US 2010/0315444 A1 Dec. 16, 2010

(30) Foreign Application Priority Data

Jun. 16, 2009 (JP) ..... 2009-143727

(51) Int. Cl.

*G09G 3/30* (2006.01)
*G09G 3/22* (2006.01)
*G09G 3/32* (2006.01)

(52) U.S. Cl.

CPC ..... *G09G 3/22* (2013.01); *G09G 2360/16* (2013.01); *G09G 2320/106* (2013.01); *G09G 2330/021* (2013.01); *G09G 3/3208* (2013.01)
USPC ..... 345/77

(58) Field of Classification Search

CPC ..... G09G 3/22
USPC ..... 345/36, 39, 45, 46, 76–80, 82, 83, 690, 345/102; 315/169.1–169.3; 382/169, 190; 367/97.1, 97.2
See application file for complete search history.

(56) References Cited

U.S. PATENT DOCUMENTS

2007/0126672 A1* 6/2007 Tada et al. ..... 345/77
2007/0146344 A1* 6/2007 Martin et al. ..... 345/173
2008/0309610 A1* 12/2008 Yoshida et al. ..... 345/102
2009/0167957 A1* 7/2009 Joo et al. ..... 348/687
2009/0170564 A1* 7/2009 Mori et al. ..... 455/566
2009/0207193 A1* 8/2009 Isobe et al. ..... 345/690
2009/0290807 A1* 11/2009 Marchesotti ..... 382/261
2010/0232704 A1* 9/2010 Thorn ..... 382/195

FOREIGN PATENT DOCUMENTS

JP 2008-158399 7/2008

* cited by examiner

*Primary Examiner* — Pegeman Karimi
(74) *Attorney, Agent, or Firm* — Oblon, Spivak, McClelland, Maier & Neustadt, L.L.P.

(57) ABSTRACT

A self-light-emitting display device includes: a video analyzing section configured to extract a feature portion of video data based on a video signal of the video data to be displayed on an active matrix driven type self-light-emitting display module; a luminance distribution generating section configured to generate, based on the feature portion, a luminance distribution for a region of the feature portion to be displayed on the self-light-emitting display module so that the display brightness of the video data becomes reduced as the distance becomes farther from an arbitrary reference position within the region of the feature portion; and an image combining section configured to combine the luminance distribution with the video signal of the video data to modify the brightness of the video data.

9 Claims, 5 Drawing Sheets

SELF-LIGHT-EMITTING DISPLAY DEVICE, POWER CONSUMPTION REDUCTION METHOD, AND PROGRAM

BACKGROUND OF THE INVENTION

1. Field of the Invention

The present invention relates to a self-light-emitting display device, a power consumption reduction method, and a program.

2. Description of the Related Art

A self-light-emitting display such as an organic EL display has a wider viewing angle and a faster response time compared with a non-self-light-emitting type liquid crystal display. In addition, since no backlight is necessary, a self-light-emitting display can be made thin, and can achieve high brightness, high contrast and the like.

In a self-light-emitting display, the higher the average display brightness within the screen, the greater the power consumption. In some cases of the related art, the screen brightness is reduced in order to reduce power consumption. When this method is used, although the power consumption can be reduced readily, there is a problem that reduction in the screen brightness reduces the quality of the display.

The technique in JP-A-2008-158399 limits the screen brightness reduction to a minimum in the regions where the eyes focus, while reducing the brightness of the portions in the screen to which a viewer would not readily pay attention. As a result, the technique in JP-A-2008-158399 can reduce power consumption.

SUMMARY OF THE INVENTION

There is a method, which is a technique mainly applied in liquid crystal displays, of controlling the gamma curve of a video signal to increase the intermediate brightness, thereby increasing the contrast of an image when the screen brightness is reduced. However, it is difficult for this technique to reduce power consumption. In addition, controlling the gamma curve also alters the original color that a video signal intended to represent originally. As a result, there is a problem that the quality of the display becomes difficult to maintain.

In addition, in JP-A-2008-158399, the point on the screen where the brightness reduction is limited to a minimum within the entire screen is the point at the center of the screen, or the point where the brightness is maximum among the respective frames. However, this method has a problem that when a subject displayed on the screen moves, the screen brightness at a position that a viewer is watching sometimes becomes reduced. In addition, there is a problem that when the surface area of the self-light-emitting display is large, if the screen brightness at a position that the viewer is watching is set to be reduced, the viewer becomes sensitive to the reduction in brightness, therefore, a feeling of discomfort occurs.

Further, in JP-A-2008-158399, the point where the reduction in screen brightness is set to a minimum may be a point where the setting is performed individually by coupling with application software. However, JP-A-2008-158399 does not disclose at all how individual setting is carried out concretely, which is technically insufficient.

The present invention addresses the above-identified problems, and it is desirable to provide a novel and improved self-light-emitting display device, power consumption reduction method, and program capable of reducing power consumption while keeping the contrast of an image without causing user's discomfort.

According to an embodiment of the present invention, there is provided a self-light-emitting display device including a video analyzing section configured to extract a feature portion of video data based on a video signal of the video data to be displayed on an active matrix driven type self-light-emitting display module, a luminance distribution generating section configured to generate, based on the feature portion, a luminance distribution for a region of the feature portion to be displayed on the self-light-emitting display module so that the display brightness of the video data becomes reduced as the distance becomes farther from an arbitrary reference position within the region of the feature portion, and an image combining section configured to combine the luminance distribution with the video signal of the video data to modify the brightness of the video data.

The video analyzing section may recognize a person face to be displayed based on the video data to extract the feature portion.

The video analyzing section may analyze the amount of travel of an object to be displayed based on the video data to extract the feature portion.

The video analyzing section may detect a still portion in the image to be displayed based on the video data to extract the feature portion.

The video analyzing section may analyze the histogram of the video data, and the luminance distribution generating section may determine the extent of reduction in display brightness of the video data based on the analysis result of the histogram.

The video analyzing section may divide the screen of the self-light-emitting display module into a plurality of regions to extract the feature portion of the video data for each divided region.

According to another embodiment of the present invention, there is provided a power consumption reduction method including the steps of: allowing a video analyzing section to extract a feature portion of video data based on a video signal of the video data to be displayed on an active matrix driven type self-light-emitting display module; allowing a luminance distribution generating section to generate, based on the feature portion, a luminance distribution for a region of the feature portion to be displayed on the self-light-emitting display module so that the display brightness of the video data becomes reduced as the distance becomes farther from an arbitrary reference position within the region of the feature portion; and allowing an image combining section to combine the luminance distribution with the video signal of the video data to modify the brightness of the video data.

According to still another embodiment of the present invention, there is provided a program causing a computer to execute the steps of: allowing a video analyzing section to extract a feature portion of video data based on a video signal of the video data to be displayed on an active matrix driven type self-light-emitting display module; allowing a luminance distribution generating section to generate, based on the feature portion, a luminance distribution for a region of the feature portion to be displayed on the self-light-emitting display module so that the display brightness of the video data becomes reduced as the distance becomes farther from an arbitrary reference position within the region of the feature portion; and allowing an image combining section to combine the luminance distribution with the video signal of the video data to modify the brightness of the video data.

According to the embodiments of the present invention, power consumption can be reduced while keeping the contrast of an image without causing user's discomfort.

DESCRIPTION OF THE PREFERRED EMBODIMENT

A preferred embodiment of the present invention will now be described with reference to the accompanying drawings. In the specification and drawings, components having substantially like functional constitutions are denoted by like numerals to omit redundant descriptions.

The description will be provided in the following order.

1. Configuration of First Embodiment
2. Operation of First Embodiment

1. Configuration of First Embodiment

Figure 1:
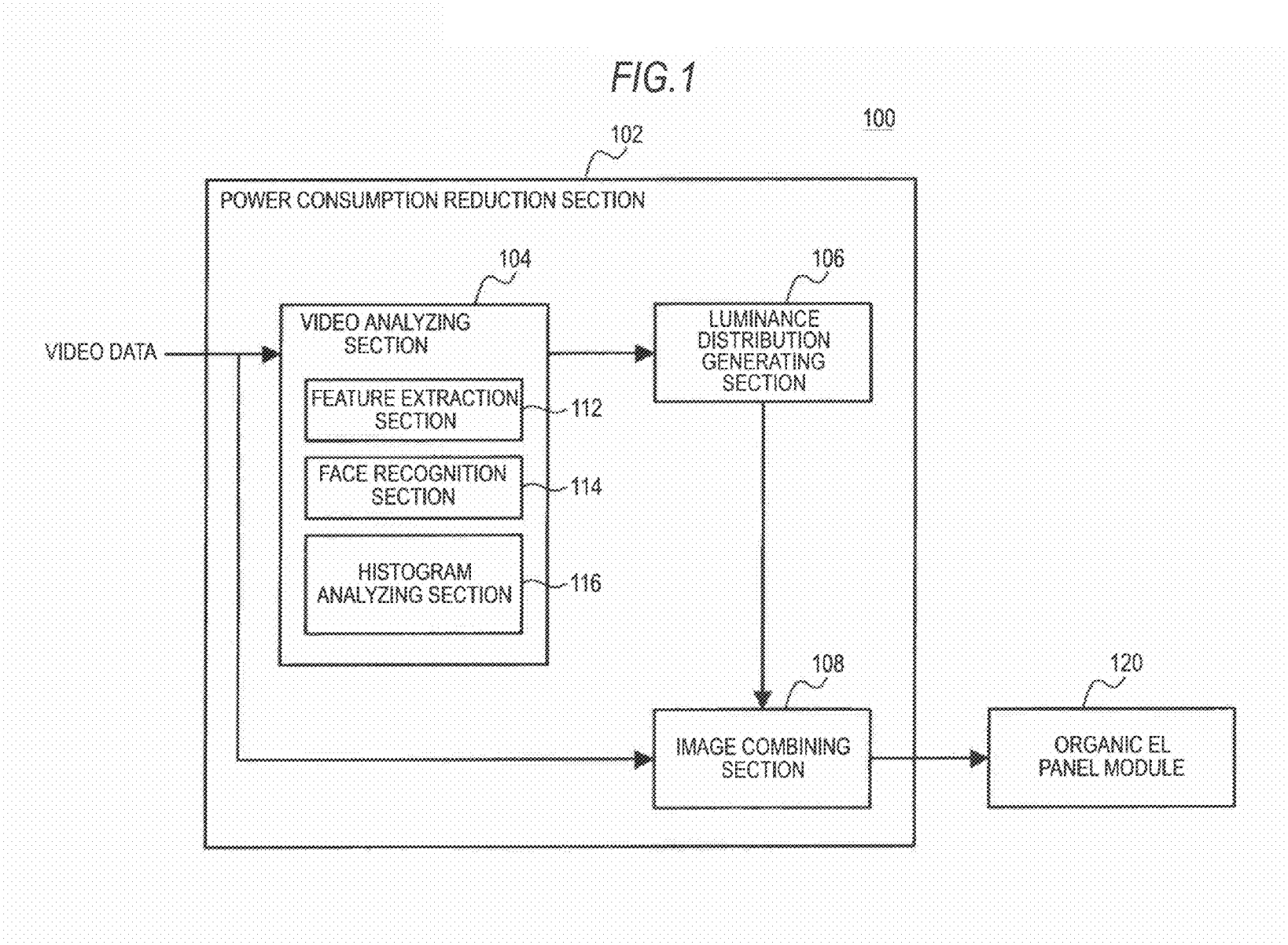
FIG. 1 is a block diagram illustrating an organic EL display device according to an embodiment of the present invention.

First, the configuration of an organic EL display device 100 according to a first embodiment of the present invention will be described with reference to FIG. 1. FIG. 1 is a block diagram illustrating the organic EL display device 100 according to the present embodiment.

The organic EL display device 100 according to the present embodiment is an example of a self-light-emitting display device, and includes a power consumption reduction section 102 and an organic EL panel module 120, for example. The organic EL panel module 120 is an example of an active matrix driven type self-light-emitting display module.

The organic EL panel module 120 includes an organic EL panel and a driver IC block. In the organic EL panel, pixels are arranged in the form of a matrix according to the panel resolution. The organic EL panel is, for example, for color display use with pixels arranged for each light-emission color. However, in the case of an organic EL element with pixels having a constitution in which light-emitting layers for a plurality of colors are layered, one pixel corresponds to a plurality of light-emission colors. A driver IC block has a data line driver for driving and controlling data lines, and a scan line driver for driving and controlling scan lines. The driver IC block further includes a timing generator for providing drive timing to data line drivers and scan line drivers.

The power consumption reduction section 102 is a processing device for reducing power consumption while modifying the brightness of the video data in such a way that a reduction in the image quality is not visually identified. The power consumption reduction section 102 according to the present embodiment includes such as a video analyzing section 104, a luminance distribution generating section 106, and an image combining section 108.

The video analyzing section 104 receives video data to be displayed on the organic EL panel module 120. Then, the video analyzing section 104 extracts a feature portion of the video data based on a video signal of the video data to be displayed on the organic EL panel module 120. The feature portion of the video data is, for example, a person face, a person or an object moving within the screen, a person or an object that remains still within the screen for a given period of time or longer, and the like, to be displayed based on the video data. In addition, the video analyzing section 104 analyzes the histogram of the video data. The analysis of the video analyzing section 104 may be performed on the entire screen, or on each divided region by dividing the screen into any number of regions.

The luminance distribution generating section 106 generates, based on the feature portion, a luminance distribution for a region of the feature portion to be displayed on the organic EL panel module 120 so that the display brightness of the video data becomes reduced as the distance becomes farther from an arbitrary reference position within the region of the feature portion extracted by the video analyzing section 104. The luminance distribution generating section 106 also determines the extent of reduction in display brightness of the video data, which indicates by how much the display brightness of the video data is to be reduced based on the analysis result of the histogram of the video analyzing section 104.

The image combining section 108 receives video data to be displayed on the organic EL panel module 120. The image combining section 108 also receives data regarding a luminance distribution from the luminance distribution generating section 106. Then, the image combining section 108 combines the luminance distribution with the video signal of the video data to modify the brightness of the video data. Thereafter, the image combining section 108 outputs the video data in which the brightness has been modified to the organic EL panel module 120. This results in a brightness distribution to be generated in the video data, reducing the display brightness, and thus allowing the power consumption to be reduced.

The image combining section 108 adds data regarding a luminance distribution to the video signal in a linear space. Adding data to the video signal in the linear space allows the brightness alone to be modified without altering the color in the video data.

Next, the video analyzing section 104 described above will be described.

The video analyzing section 104 includes a feature extraction section 112, a face recognition section 114 and a histogram analyzing section 116, for example. The configuration of the video analyzing section 104 is not limited thereto, and other configurations may be used as long as the feature portion of the video data is extracted based on the video signal of the video data.

The feature extraction section 112 analyzes the amount of travel of an object to be displayed on the screen based on the video data to extract a feature portion, for example. The feature extraction section 112 extracts, for example, a moving object as a feature portion. In addition, the feature extraction section 112 detects a still portion in the image to be displayed based on the video data to extract a feature portion. The feature extraction section 112 extracts, for example, a person or an object that remains still within the screen for a given period of time or longer as a feature portion.

The face recognition section 114 recognizes a person face to be displayed based on the video data to extract a feature portion. The face recognition section 114 extracts a person face as a feature portion.

The histogram analyzing section 116 analyzes the histogram of the video data. When the luminance distribution generating section 106 generates a luminance distribution, the analysis result is used to determine to which extent the overall brightness is to be reduced, to which extent the brightness of the background is to be reduced, and the like.

2. Operation of First Embodiment

Figure 2:
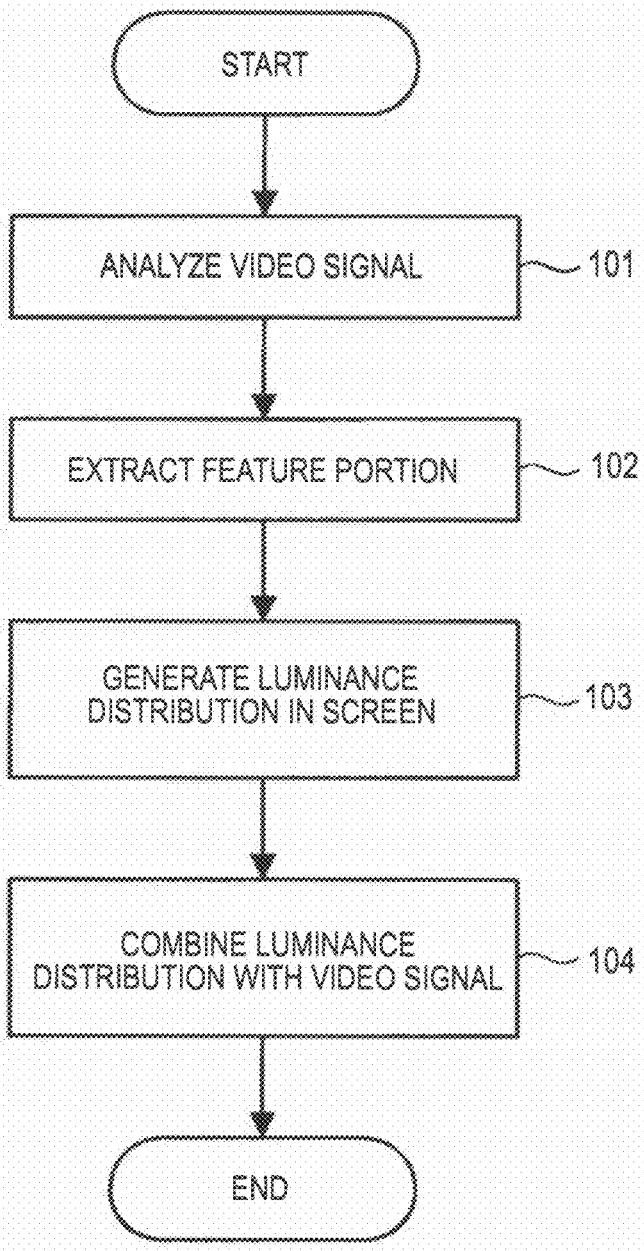
FIG. 2 is a flowchart illustrating the operation of the organic EL display device according to the embodiment of the present invention.

Next, the operation of the organic EL display device 100 according to the first embodiment of the present invention will be described. FIG. 2 is a flowchart illustrating the operation of the organic EL display device 100 according to the present embodiment.

First, the video analyzing section 104 receives video data and analyzes a video signal (step S101). The analysis of the video signal analyzes, for example, whether a person or an object is contained in the video data, if contained, analyzes where and how large the content is, the amount of travel or the still state of the person or the object, and the like. Then, the video analyzing section 104 extracts a characteristic portion from the analysis result (step S102). For example, a person face to be displayed based on the video data, a person or an object moving in the screen, and a person or an object that remains still within the screen for a given period of time or longer are extracted as a feature portion. From one frame, a plurality of feature portions may be extracted, or only one feature portion may be extracted. In addition, the video analyzing section 104 analyzes the histogram of the video data.

Next, based on the extraction result of the feature portion, a luminance distribution is generated on the region of the feature portion displayed on the organic EL panel module 120 (step S103).

Based on the extraction result of the detected feature portion or the histogram analysis result, the luminance distribution generating section 106 determines a distribution range for the luminance distribution to be combined with the video data or a range for reducing the brightness, and generates the illumination distribution corresponding to the determined distribution range or brightness range. For example, a reference position is set within the region of the feature portion extracted by the video analysis section 104 and the display brightness of the video data is set to become reduced as the distance becomes farther from this reference position, to generate the luminance distribution.

Figure 3A:
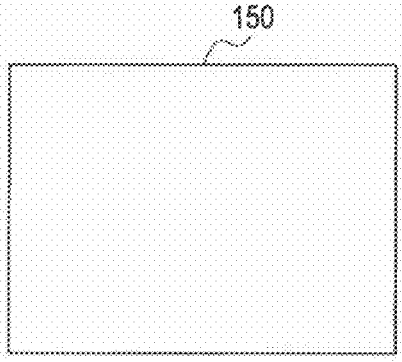
FIG. 3A is an explanatory view illustrating an example of a screen displayed based on video data.
Figure 3B:
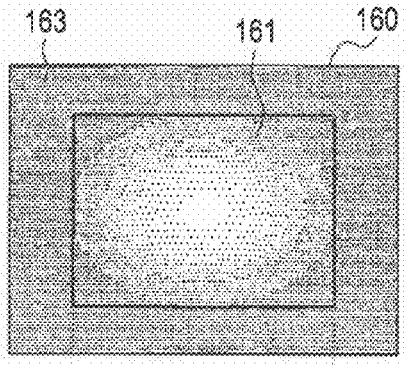
FIG. 3B is an explanatory view illustrating an example of a luminance distribution.

FIG. 3A is an explanatory view illustrating an example of a screen 150 displayed based on a video data. In this case, the entire surface is assumed to be at the white level (100% brightness). FIG. 3B is an explanatory view illustrating an example of a luminance distribution. In this case, a pattern is assumed, in which, in the region 161 of the central portion of the screen, the brightness is gradually reduced in concentric directions with the center at the center of the screen, and in the region 163 located outside thereof, the brightness level of the outer edge portion of the region 161 is maintained.

Figure 3C:
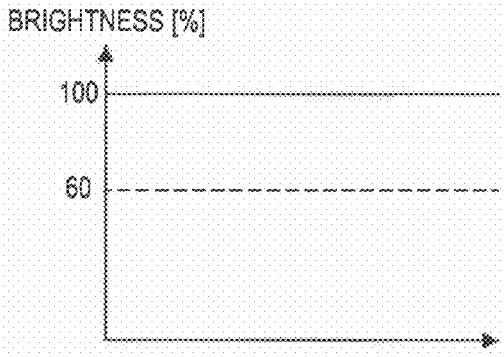
FIG. 3C is an explanatory view illustrating the change in brightness level of the screen of FIG. 3A in a diagonal direction.
Figure 3D:
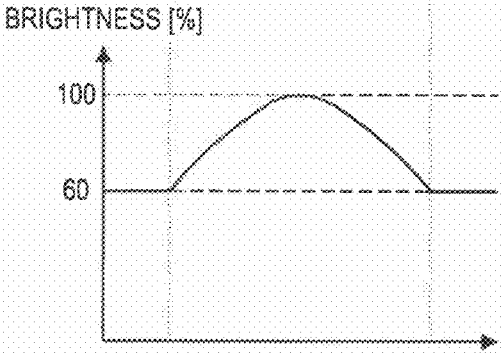
FIG. 3D is an explanatory view illustrating the brightness level of the luminance distribution of FIG. 3B in a diagonal direction.

FIG. 3C is an explanatory view illustrating the change in brightness level of the screen of FIG. 3A in a diagonal direction of the screen. FIG. 3D is an explanatory view illustrating the brightness level of the luminance distribution of FIG. 3B in a diagonal direction. As shown in FIG. 3D, the brightness level varies following a parabola only in the region 161, and a brightness level of 60% is maintained outside thereof.

The determination and generation of the distribution range of the luminance distribution and the brightness range are not limited to the above. A variety of patterns may be assumed, such as, taking the maximum reference point as the center and gradually reducing the brightness until the farthest ends of the display screen.

A property necessary for the luminance distribution is that when the luminance distribution that exerts the effect of power consumption reduction is combined with the video data, the change in the brightness that occurs is not caught by the eyes. For this to be realized, the property necessary for the luminance distribution includes the following three conditions, for example.

(a) The screen brightness after superposition of the luminance distribution decreases uniformly and continuously outward from the maximum brightness point (center of the screen in the case of FIG. 3B). (b) The degree of brightness uniformity of a general display device is taken into consideration to set the maximum value of the amount of brightness reduction. For example, the maximum value of the amount of brightness reduction (maximum brightness reduction ratio) is set to about 40%. In other words, the setting is such that the brightness is about 60% at the pixel position where the brightness is reduced most. (c) In the vicinity of the maximum brightness point after the luminance distribution has been combined, the brightness gradient becomes equal to other region portions or shallower compared to other region portions.

The luminance distribution shown in FIG. 3B is generated so that these three conditions are satisfied. FIG. 3B uses dot shading to represent the brightness properties after the luminance distribution has been combined, and is not related to actual display contents.

Figure 4:
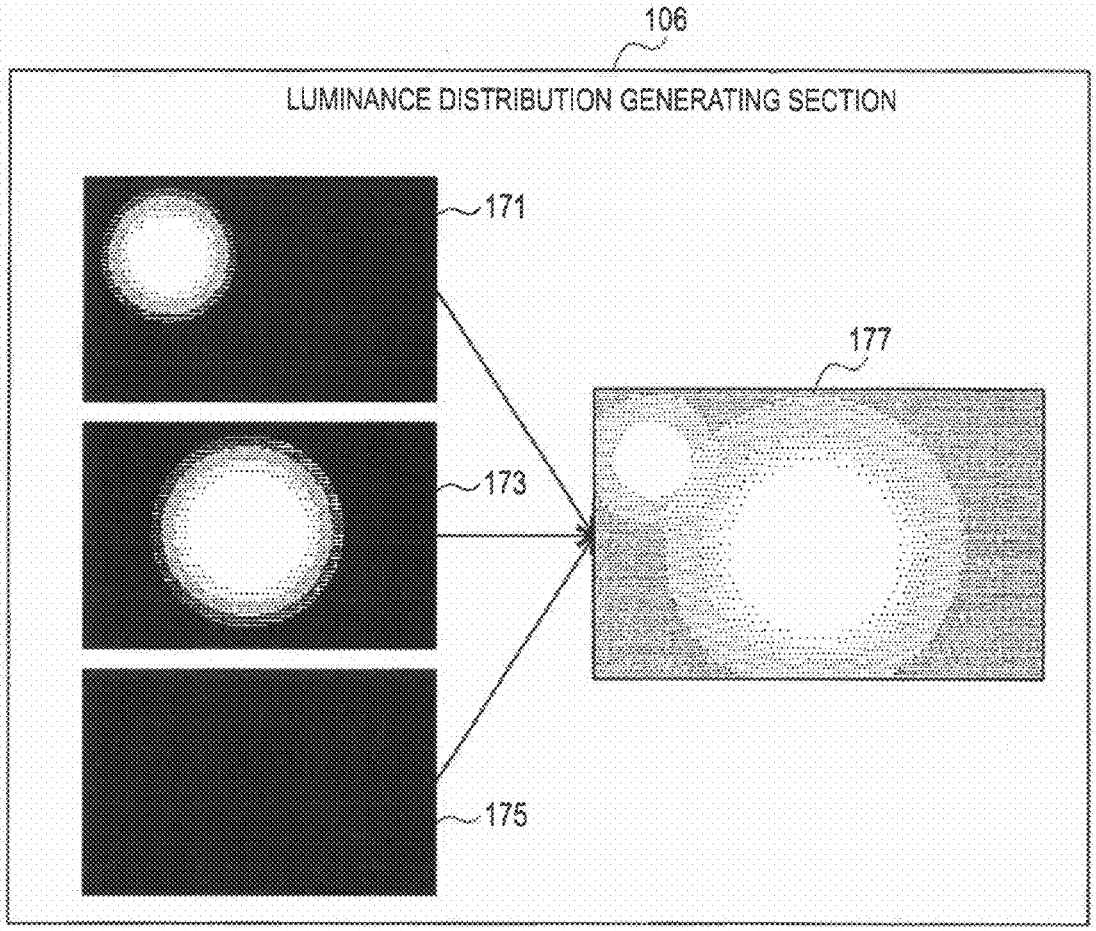
FIG. 4 is an explanatory view schematically illustrating the operation of a luminance distribution generating section.

Next, a case where a plurality of feature portions are extracted will be described with reference to FIG. 4. FIG. 4 is an explanatory view schematically illustrating the operation of the luminance distribution generating section 106. For example, when a feature portion is detected on the upper left with one algorism of the feature extraction section 112, a luminance distribution 171 is generated, and when a feature portion is detected at around the center with the face recognition section 114, a luminance distribution 173 is generated. Further, when no feature portion is detected with other algorisms of the feature extraction section 112, a luminance distribution 175 is generated. Then, the luminance distribution generating section 106 combines a plurality of generated luminance distributions to generate a luminance distribution 177, for example. Then, the luminance distribution generating section 106 sends the combined luminance distribution 177 to the image combining section 108. The luminance distribution shown in FIG. 4 uses dot shading to represent the brightness properties, and is not related to actual display contents.

Figure 5A:
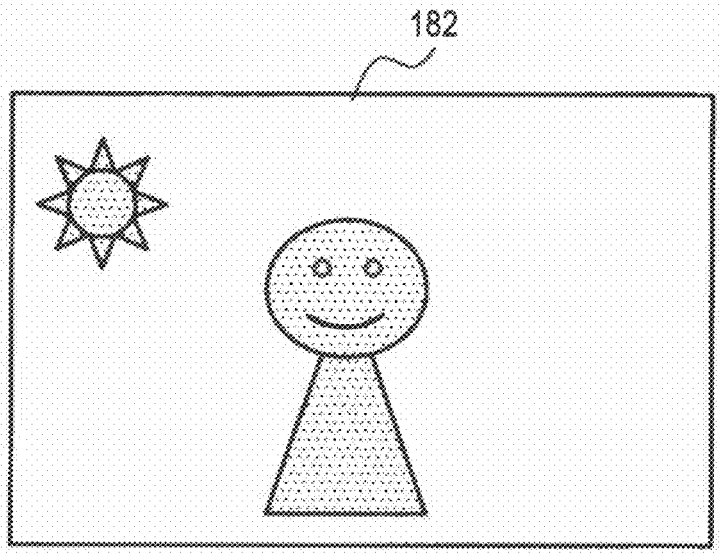
FIG. 5A is an explanatory view illustrating an example of a screen displayed based on video data.
Figure 5B:
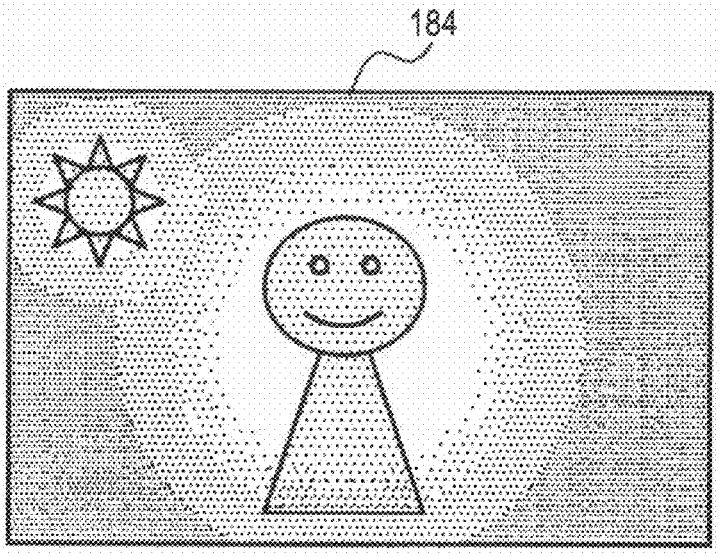
FIG. 5B is an explanatory view illustrating an image obtained by combining the luminance distribution with the video data.

After the luminance distribution is generated in step S103 in this manner, the image combining section 108 combines the luminance distribution with the video signal (step S104). FIG. 5A is an explanatory view illustrating an example of a screen 150 displayed based on a video data. FIG. 5B is an explanatory view illustrating an image obtained by combining the luminance distribution with the video data. The luminance distribution shown in FIG. 5B uses dot shading to represent the brightness properties, and is not related to actual display contents.

The result of combining the luminance distribution with the video signal is based on the feature portions extracted from the video signal. Namely, a video can be obtained in which the brightness of the feature portion is high, and the brightness of other regions is low. If the feature portion is extracted according to the region to which the viewer pays attention, no discomfort occurs in the viewer even if the brightness is reduced in regions other than the region to which the viewer pays attention. Then, the power consumption can be reduced while keeping the contrast of the image.

In this manner, a plurality of feature extraction algorisms, such as video histogram analysis, face recognition, screen brightness distribution analysis, travel amount analysis and intra-screen still image detection, are used to extract the feature portion(s) to which the viewer pays attention. Then, not by flatly representing the video to be displayed but by relatively increasing the brightness of the extracted feature portion(s) and reducing the brightness of the other regions, sharpness can be provided to the video as well as the power consumption reduced. Namely, the portion where the brightness is high can be kept with the contrast of the image increased, while the portion where the brightness is low contributes to the reduction in power consumption. As a result, according to the present embodiment, both low power consumption and improved image quality can be achieved.

Although the preferred embodiment of the present invention has been described in detail with reference to the accompanying drawings, the present invention is not limited thereto. It should be clear to a person of ordinary knowledge in the art pertaining to the present invention, that various variants and modifications may be achieved within the technical ideas described in the claims and that these are understood to be included in the technical scope of the present invention.

For example, in the above embodiment, an organic EL display device is taken as an example of the self-light-emitting display device, but the present invention is not limited thereto. The self-light-emitting display device may be a self-light-emitting display device other than an organic EL display device.

The present application contains subject matter related to that disclosed in Japanese Priority Patent Application JP 2009-143727 filed in the Japan Patent Office on Jun. 16, 2009, the entire contents of which is hereby incorporated by reference.

What is claimed is:

1. A self-light-emitting display device comprising:

circuitry configured to extract a feature portion of video data based on a video signal of the video data to be displayed on an active matrix driven type self-light-emitting display;

generate, based on the feature portion, a uniform and continuous luminance distribution for a region of the feature portion to be displayed on the self-light-emitting display so that the display brightness of the video data becomes reduced as the distance becomes farther from an arbitrary reference position within the region of the feature portion; and combine the luminance distribution with the video signal of the video data to modify the brightness of the video data, wherein the uniform and continuous luminance distribution is parabolic within the region of feature portion, portions of the display area outside the region of the feature portion having a lowest and flat brightness level relative to the arbitrary reference position.

2. The self-light-emitting display device according to claim 1, wherein the circuitry recognizes a face of a person to be displayed based on the video data to extract the feature portion.

3. The self-light-emitting display device according to claim 1, wherein the circuitry analyzes the amount of travel of an object to be displayed based on the video data to extract the feature portion.

4. The self-light-emitting display device according to claim 1, wherein the circuitry detects a still portion in the image to be displayed based on the video data to extract the feature portion.

5. The self-light-emitting display according to claim 1, wherein the circuitry analyzes a histogram of the video data, and determines an extent of reduction in display brightness of the video data based on an analysis result of the histogram.

6. The self-light-emitting display device according to claim 1, wherein the circuitry divides the screen of the self-light-emitting display into a plurality of regions to extract the feature portion of the video data for each divided region.

7. The self-light-emitting display device according to claim 1, wherein a brightness of the display area outside the region of the feature portion is constant.

8. A power consumption reduction method comprising:

extracting a feature portion of video data based on a video signal of the video data to be displayed on an active matrix driven type self-light-emitting display;

generating, based on the feature portion, a uniform and continuous luminance distribution for a region of the feature portion to be displayed on the self-light-emitting display so that the display brightness of the video data becomes reduced as the distance becomes farther from an arbitrary reference position within the region of the feature portion; and combining the luminance distribution with the video signal of the video data to modify the brightness of the video data, wherein the uniform and continuous luminance distribution is parabolic within the region of feature portion, portions of the display area outside the region of the feature portion having a lowest and flat brightness level relative to the arbitrary reference position.

9. A non-transitory computer-readable medium encoded with computer-readable instructions thereon, the computer-readable instruction when executed by a computer cause the computer to perform a method comprising:

extracting a feature portion of video data based on a video signal of the video data to be displayed on an active matrix driven type self-light-emitting display;

generating, based on the feature portion, a uniform and continuous luminance distribution for a region of the feature portion to be displayed on the self-light-emitting display so that the display brightness of the video data becomes reduced as the distance becomes farther from an arbitrary reference position within the region of the feature portion; and combining the luminance distribution with the video signal of the video data to modify the brightness of the video data, wherein the uniform and continuous luminance distribution is parabolic within the region of feature portion, portions of the display area outside the region of the feature portion having a lowest and flat brightness level relative to the arbitrary reference position.

* * * * *